US010500601B2

(12) United States Patent
Zhang

(10) Patent No.: US 10,500,601 B2
(45) Date of Patent: Dec. 10, 2019

(54) INTEGRATED SPRAY MACHINE

(71) Applicant: Minggui Zhang, Zhejiang (CN)

(72) Inventor: Minggui Zhang, Zhejiang (CN)

(73) Assignee: FENGHUA BIDA MACHINERY MANUFACTURE CO., LTD. (CN)

( * ) Notice: Subject to any disclaimer, the term of this patent is extended or adjusted under 35 U.S.C. 154(b) by 188 days.

(21) Appl. No.: 15/654,391

(22) Filed: Jul. 19, 2017

(65) Prior Publication Data

US 2019/0022688 A1 Jan. 24, 2019

(51) Int. Cl.

| | |
|---|---|
| ***B05B 17/06*** | (2006.01) |
| ***B05B 7/12*** | (2006.01) |
| ***B05B 9/08*** | (2006.01) |
| ***B05B 12/00*** | (2018.01) |
| *B05B 5/025* | (2006.01) |
| *A45D 34/04* | (2006.01) |
| *B05B 7/24* | (2006.01) |

(52) U.S. Cl.

CPC ..... *B05B 17/0607* (2013.01); *B05B 7/1209* (2013.01); *B05B 9/0855* (2013.01); *B05B 9/0861* (2013.01); *B05B 12/002* (2013.01); *A45D 34/04* (2013.01); *A45D 2200/057* (2013.01); *B05B 5/025* (2013.01); *B05B 7/247* (2013.01); *B05B 7/2416* (2013.01); *B05B 7/2435* (2013.01)

(58) Field of Classification Search

CPC . B05B 17/0607; B05B 7/1209; B05B 9/0855; B05B 9/0861; B05B 12/002

USPC ..... 239/319, 346, 332, 353

See application file for complete search history.

(56) References Cited

U.S. PATENT DOCUMENTS

| | | | | |
|---|---|---|---|---|
| 6,997,396 | B2 * | 2/2006 | Fedorov | B05B 7/2416 239/346 |
| 2011/0259978 | A1 * | 10/2011 | Ptak | B05B 7/0416 239/398 |
| 2017/0225184 | A1 * | 8/2017 | Lee | B05B 7/1209 |

* cited by examiner

*Primary Examiner* — Steven J Ganey

(57) ABSTRACT

Disclosed is an integrated spray machine which comprises a shell, a sprayer assembly, an air pump motor assembly, a battery, a circuit board and a switch, wherein the sprayer assembly comprises a housing, a container and a spray mechanism; the housing is matched with the shell, the container and the spray mechanism are mounted in the housing correspondingly, and the container communicates with a liquid inlet of the spray mechanism; the air pump motor assembly, the battery and the circuit board are all arranged in the shell, the switch is arranged on the wall of the shell, the air pump motor assembly, the battery and the switch are all electrically connected with the circuit board, and an air outlet of the air pump motor assembly communicates with an air inlet of the spray mechanism through an air pipe.

11 Claims, 3 Drawing Sheets

INTEGRATED SPRAY MACHINE

BACKGROUND OF THE INVENTION

Technical Field

The present invention relates to the technical field of beauty care tools, in particular to an integrated spray machine.

Description of Related Art

As living conditions improve, people are paying more attention to health and beauty care. Tools, such as automatic cosmetic sprayers, have become cosmetic products widely known by people. An automatic cosmetic sprayer is composed of a cup body, a spray mechanism, an air pipe and other components; when the automatic cosmetic sprayer is in use, the air pipe is connected with an air pump, after the air pump is started, cosmetic liquid at a nozzle of the spray mechanism is scattered by airflow, atomized and then sprayed out along with the airflow, and the atomized cosmetic liquid can be evenly sprayed on the face and thus can be adsorbed by the skin easily. Specifically, please see the automatic cosmetic sprayer disclosed by the patent with the application number of 201610581380.1 for a reference. However, the above automatic cosmetic sprayer has the defects in that an air pump is generally needed when a user purchases the automatic cosmetic sprayer, the user has to take care of both the automatic cosmetic sprayer and the air pump, storage is more difficult, thereby making the cosmetic sprayer more difficult to use.

SUMMARY OF THE INVENTION

For overcoming the defects and disadvantages of the prior art, the present invention provides an integrated spray machine which is compact and reasonable in structure, convenient and fast to assemble, convenient to use and good in spraying effect.

The following technical scheme is adopted by the present invention for achieving the above aim.

An integrated spray machine comprises a shell, a sprayer assembly, an air pump motor assembly, a battery, a circuit board and a switch, wherein the sprayer assembly comprises a housing, a container and a spray mechanism; the housing is matched with the shell, the container and the spray mechanism are mounted in the housing correspondingly, and the container communicates with a liquid inlet of the spray mechanism; the air pump motor assembly, the battery and the circuit board are all mounted in the shell, the switch is arranged on the wall of the shell, the air pump motor assembly, the battery and the switch are all electrically connected with the circuit board, and an air outlet of the air pump motor assembly communicates with an air inlet of the spray mechanism through an air pipe; and, a trigger starting mechanism used for controlling operation of the spray mechanism is further arranged on the shell.

Furthermore, a fixed plate is arranged in the housing, and the container and the spray mechanism are both fixedly connected with the fixed plate.

Furthermore, the spray mechanism comprises a handle body, a nozzle and a spray head arranged outside the nozzle in a covering mode are arranged at the front end of the handle body, an end cover is arranged at the rear end of the handle body, the liquid inlet and the air inlet are both formed in the wall of the handle body, the liquid inlet communicates with the front end of the spray head through a liquid channel formed in the handle body, and the air inlet communicates with the front end of the spray head through an air channel formed in the handle body; a spray needle matched with the nozzle is arranged in the handle body, and the trigger starting mechanism is in transmission connection with the spray needle and drives the spray needle to move in the axial direction, so that the liquid channel is controlled to be opened or closed.

Furthermore, a sealing assembly used for preventing liquid in the liquid channel from leaking towards the rear end of the handle body is arranged between the handle body and the spray needle.

Furthermore, a clamping screw is fixed to the middle of the spray needle, a needle valve spring is arranged between the clamping screw and the end cover in an abutting mode, and the needle valve spring causes the spray needle to close the liquid channel.

Furthermore, a lock nut is fixed to the tail end of the spray needle, the trigger starting mechanism comprises a trigger, a rocker arm and a sliding block, the trigger is arranged on the wall of the shell, the rocker arm is rotatably arranged in the shell, the sliding block is in sliding fit with the shell, the trigger, the rocker arm; the sliding block and the lock nut are in transmission connection sequentially, and a reset spring is arranged between the sliding block and the shell.

Furthermore, an air inlet connector is arranged at the air inlet, a pipe connector used for connecting the air inlet connector with the air pipe is fixed in the shell, and the air inlet connector is matched with the pipe connector in an inserted mode.

Furthermore, a plurality of first strong magnetic bars are arranged in the shell, a plurality of second strong magnetic bars in one-to-one correspondence with the first strong magnetic bars are arranged in the housing, and the housing and the shell are fixed together through attraction of the first strong magnetic bars and the second strong magnetic bars.

Furthermore, gear indicator lamps are arranged on the shell and electrically connected with the circuit board.

Furthermore, a charging port is formed in the shell and electrically connected with the circuit board.

The integrated spray machine provided by the present invention has the beneficial effects that the spray mechanism, the air pump motor assembly and the battery are integrated, the battery provides required electric power for the air pump motor assembly, the air pump motor assembly provides required compressed gas for the spray mechanism, and thus the integrated spray machine is compact and simple in structure and convenient to use; the sprayer assembly is composed of the housing, the container and the spray mechanism. During assembly, the sprayer assembly is mounted on the shell after being preassembled, and thus mounting is convenient and fast; the container is used for containing liquid such as cosmetic liquid and toning lotion, when the integrated spray machine works, the switch is turned on, and the trigger starting mechanism is triggered, so that the air pump motor assembly and the spray mechanism are made to be in the working state, liquid can be atomized through air flow accordingly, and the integrated spray machine is convenient to use and good in spraying effect.

BRIEF DESCRIPTION OF THE DRAWINGS

In FIGS. 1-5: 11, first half shell; 12, second half shell; 13, first strong magnetic bar; 21, housing; 22, container; 23, spray mechanism; 231, handle body; 2311, liquid inlet; 2312, air inlet; 232, nozzle; 233, spray head; 234, end cover; 2351, liquid channel; 2352, air channel; 236, air inlet connector; 237, spray needle; 2381, sealing plug; 2382, needle plug screw; 239, clamping screw; 240, needle valve spring; 241, lock nut; 24, fixed plate; 25, second strong magnetic bars; 3, air pump motor assembly; 4, battery; 5, circuit board; 6, switch; 7, air pipe; 71, pipe connector; 8, gear indicator lamp; 9, charging port; 101, trigger; 1011, trigger button; 1012, linking rod; 102, rocker arm; 1021, connecting section; 1022, linking section; 1023, rotary shaft; 103, sliding block; 1031, clamping port; 1032, mounting post; 1033, sliding base part; 1034, connecting part; 104, reset spring.

DETAILED DESCRIPTION OF THE INVENTION

A further description of the present invention is given with the accompanying drawings as follows.

Figure 1:
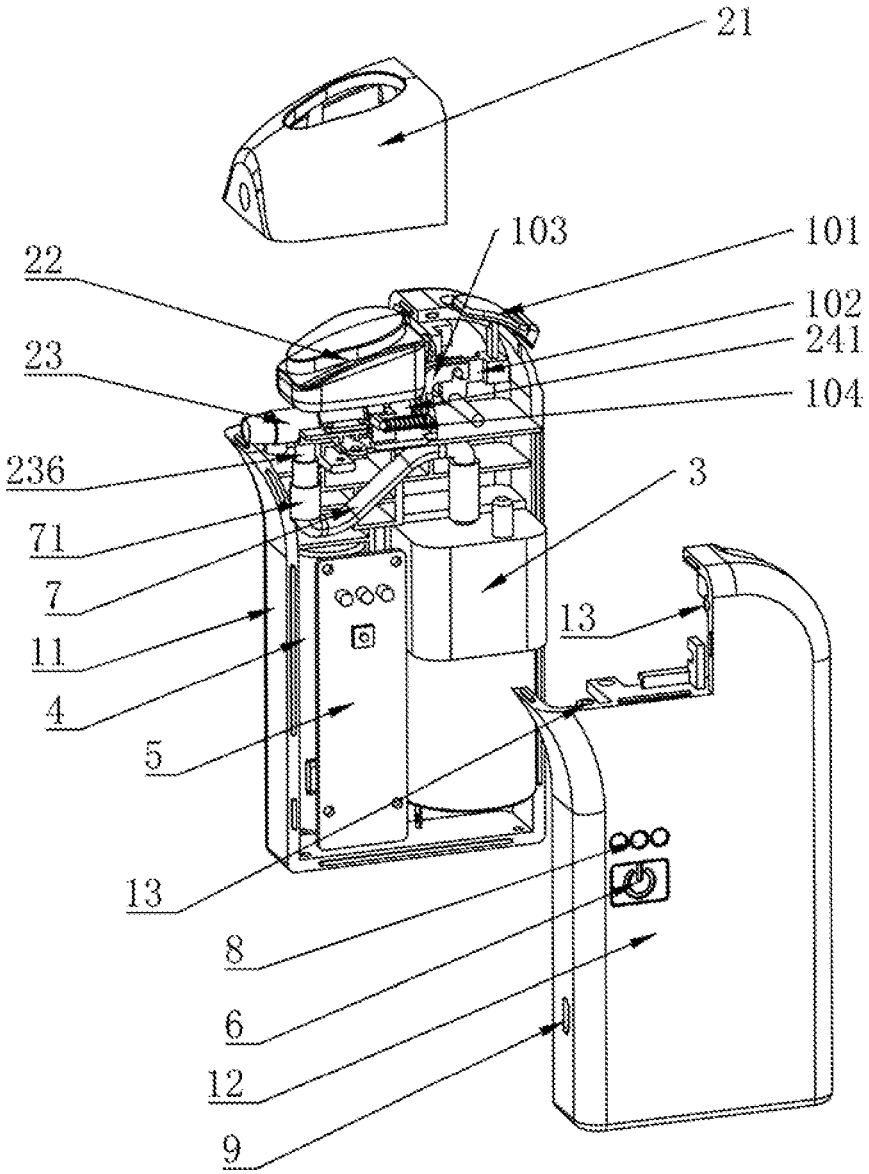
FIG. 1 is a breakdown structure schematic diagram of the integrity of the present invention.
Figure 2:
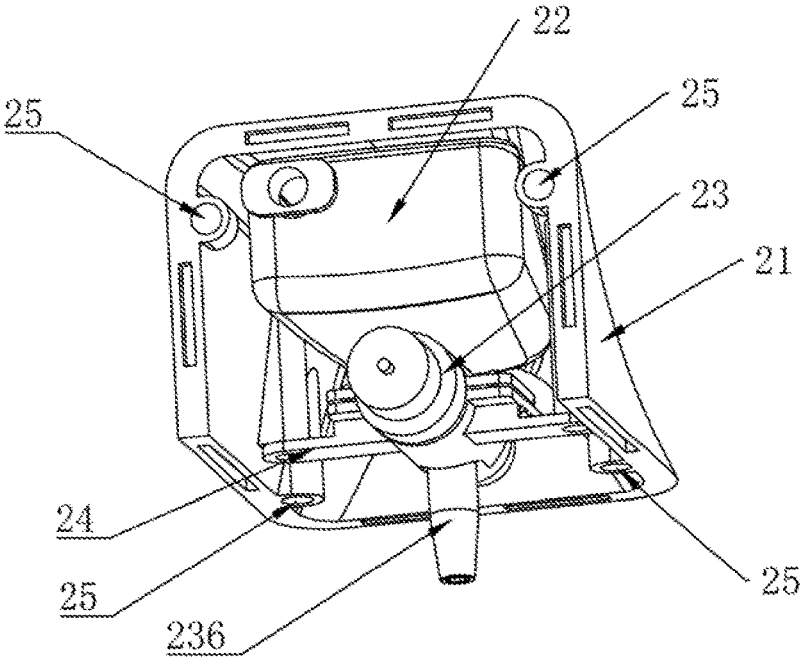
FIG. 2 is a structure schematic diagram of a sprayer assembly of the present invention.
Figure 3:
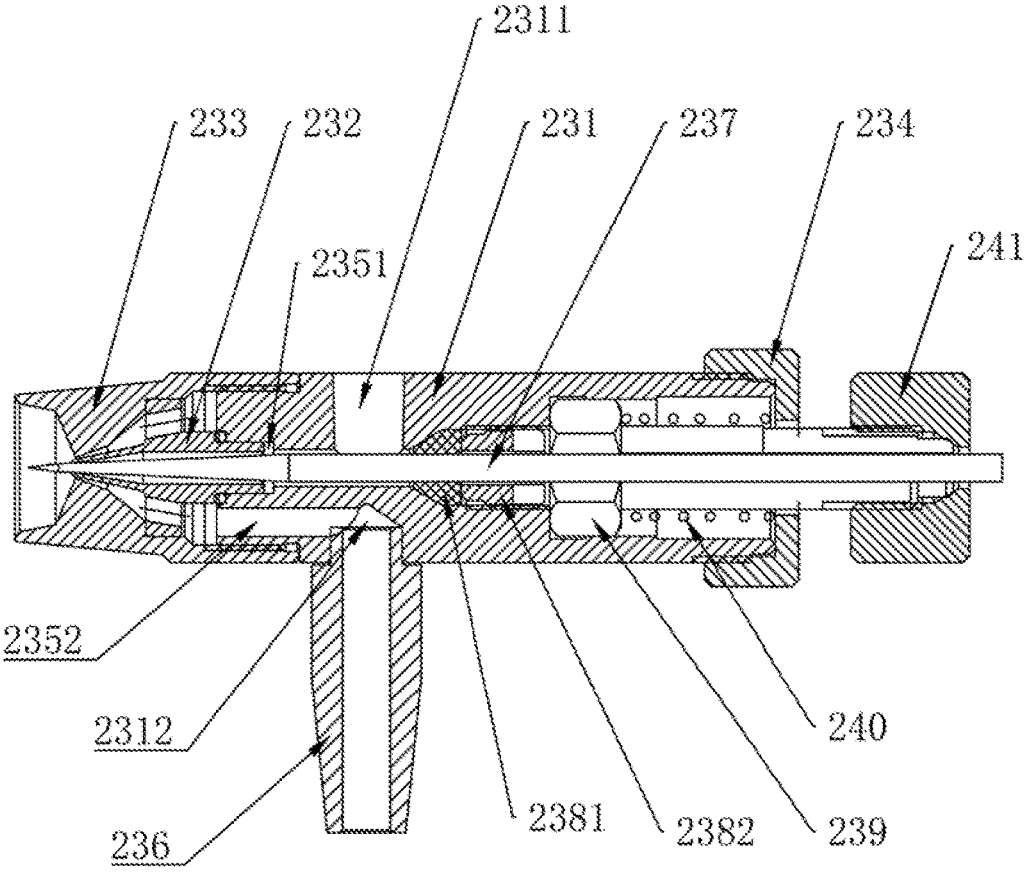
FIG. 3 is a structure schematic diagram of a spray mechanism of the present invention.
Figure 4:
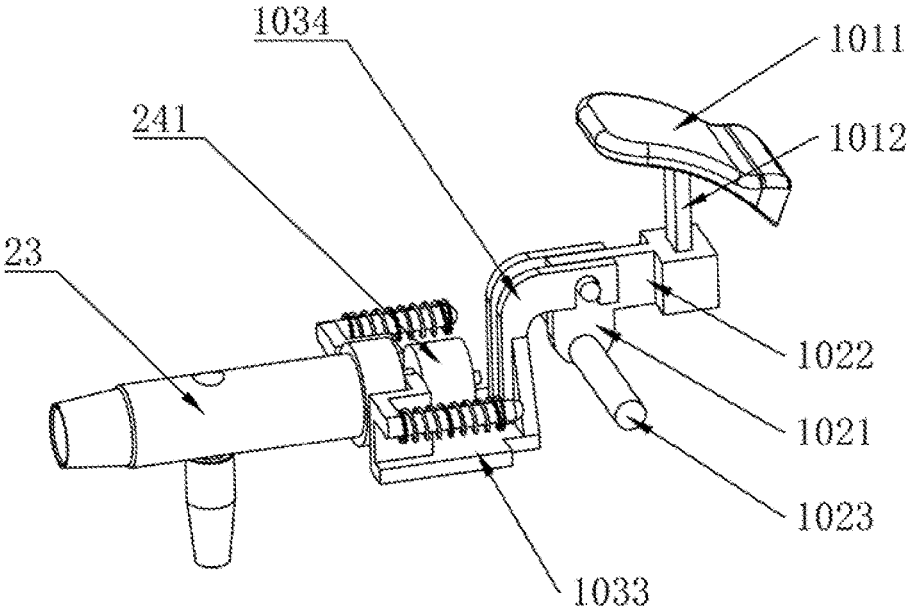
FIG. 4 is a structure schematic diagram of a trigger starting mechanism and the spay mechanism mounted in a matched mode of the present invention.
Figure 5:
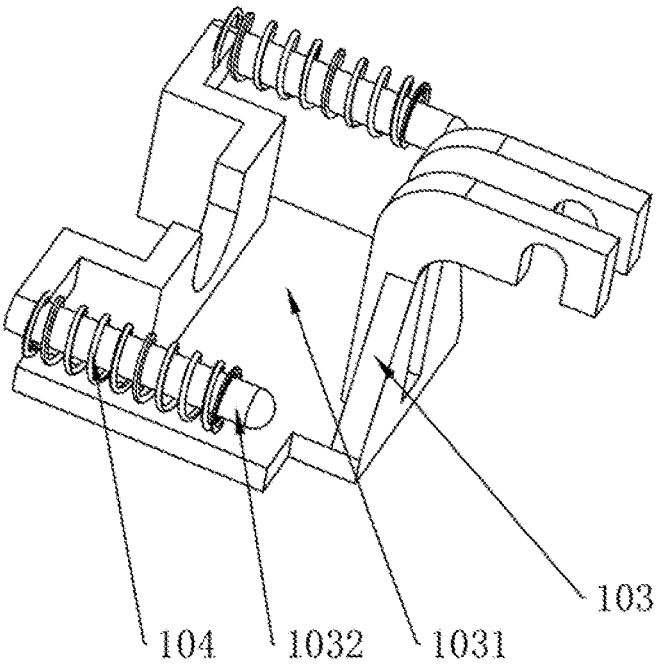
FIG. 5 is a structure schematic diagram of a sliding block of the trigger starting mechanism of the present invention.

As is shown in FIGS. 1-5, an integrated spray machine comprises a shell, a sprayer assembly, an air pump motor assembly 3, a battery 4, a circuit board 5 and a switch 6, wherein the sprayer assembly comprises a housing 21, a container 22 and a spray mechanism 23; the housing 21 is matched with the shell, the container 22 and the spray mechanism 23 are mounted in the housing 21 correspondingly, and the container 22 communicates with a liquid inlet 2311 of the spray mechanism 23. Preferably, a fixed plate 24 is arranged in the housing 21, and the container 22 and the spray mechanism 23 are both fixedly connected with the fixed plate 24; during assembling, the sprayer assembly is mounted on the shell after being preassembled, and thus mounting is convenient and fast.

In the preferred embodiment, a plurality of first strong magnetic bars 13 are arranged in the shell, a plurality of second strong magnetic bars 25 in one-to-one correspondence with the first strong magnetic bars 13 are arranged in the housing 21, the housing 21 and the shell are fixed together through attraction of the first strong magnetic bars 13 and the second strong magnetic bars 25, and thus mounting is convenient and fast. Specifically, the shell is formed by buckling a first half shell 11 and a second half shell 12 matched with the first half shell 11, thereby improving the attraction effect to make the housing 21 and the shell connected more firmly. The first half shell 11 and the second half shell 12 are each provided with two first strong magnetic bars 13. Further, four second strong magnetic bars 25 are arranged in the housing 21, two second strong magnetic bars 25 correspond to the two first strong magnetic bars 13 in the first half shell 11, and the other two second strong magnetic bars 25 correspond to the two first strong magnetic bars 13 in the second half shell 12.

In the embodiment, the air pump motor assembly 3, the battery 4 and the circuit board 5 are all mounted in the shell, the switch 6 is arranged on the wall of the shell, the air pump motor assembly 3, the battery 4 and the switch 6 are all electrically connected with the circuit board 5, and an air outlet of the air pump motor assembly 3 communicates with an air inlet 2312 of the spray mechanism 23 through an air pipe 7; preferably, an air inlet connector 236 is arranged at the air inlet 2312 of the spray mechanism 23, a pipe connector 71 used for connecting the air inlet connector 236 with the air pipe 7 is fixed in the shell, and the air inlet connector 236 is matched with the pipe connector 71 in an inserted mode; during assembly, the spraying mechanism 23 and the air pipe 7 can be connected rapidly by directly inserting the air inlet connector 236 into the pipe connector 71. During use, the battery 4 provides required electric power for the air pump motor assembly 3, and the air pump motor assembly 3 provides required compressed gas for the spray mechanism 23.

In the embodiment, gear indicator lamps 8 are arranged on the shell and electrically connected with the circuit board 5. Specifically, the air pump motor assembly 3 has a high-gear working mode, a medium-gear working mode and a low-gear working mode. Additionally, the number of the gear indicator lamps 8 is three, and the three gear indicator lamps 8 correspond to the three different working modes of the air pump motor assembly 3 respectively. A charging port 9 is formed in the shell and electrically connected with the circuit board 5, and thus a user can charge the battery 4 conveniently.

In the embodiment, the spray mechanism 23 comprises a handle body 231, a nozzle 232 and a spray head 233 arranged outside the nozzle 232 in a covering mode are arranged at the front end of the handle body 231, an end cover 234 is arranged at the rear end of the handle body 231, the liquid inlet 2311 and the air inlet 2312 are both formed in the wall of the handle body 231, the liquid inlet 2311 communicates with the front end of the spray head 233 through a liquid channel 2351 formed in the handle body 231, and the air inlet 2312 communicates with the front end of the spray head 233 through an air channel 2352 formed in the handle body 231. During use, liquid such as cosmetic liquid and toning lotion in the container 22 flows to the front end of the spray head 233 through the liquid channel 2351 and atomized through compressed gas flowing to the front end of the spray head 233, and the atomized liquid is sprayed out through the housing 21 and evenly sprayed on the skin surface of the user. A spray needle 237 matched with the nozzle 232 is arranged in the handle body 231, and the liquid channel 2351 can be controlled to be opened or closed by controlling axial movement of the spray needle 237.

Preferably, a sealing assembly used for preventing liquid in the liquid channel 2351 from leaking towards the rear end of the handle body 231 is arranged between the handle body 231 and the spray needle 237. Specifically, the sealing assembly is composed of a sealing plug 2381 and a needle plug screw 2382 which are sequentially arranged from front to back and matched with each other, and the sealing plug 2381 is axially limited between the handle body 231 and the needle plug screw 2382. A clamping screw 239 is fixed to the middle of the spray needle 237, a needle valve spring 240 is arranged between the clamping screw 239 and the end cover 234 in an abutting mode, and the needle valve spring 240 is used for making the spray needle 237 to have the tendency to close the liquid channel 2351. When the spray needle 237 moves backwards under the effect of external force, the liquid channel 2351 is opened, and the needle valve spring 240 is compressed; when external force borne by the spray needle 237 is released, the needle valve spring 240 drives the spray needle 237 to move forwards, and thus the liquid channel 2351 is closed.

In the embodiment, a trigger starting mechanism used for controlling operation of the spray mechanism 23 is further arranged on the shell. Specifically, the trigger starting mechanism is in transmission connection with the spray needle 237. Preferably, a lock nut 241 is fixed to the tail of the spray needle 237, the trigger starting mechanism comprises a trigger 101, a rocker arm 102 and a sliding block 103, the trigger 101 is arranged on the wall of the shell, the rocker arm 102 is rotatably arranged in the shell, the sliding block 103 is in sliding fit with the shell, the trigger 101, the rocker arm 102, the sliding block 103 and the lock nut 241 are in transmission connection sequentially, and a reset spring 104 is arranged between the sliding block 103 and the shell. In the embodiment, the trigger 101, the rocker arm 102, the sliding block 103 and the lock nut 241 are fixedly connected in sequence.

Specifically, in the embodiment, the trigger 101 comprises a trigger button 1011 and a linking rod 1012 which are fixed together; the rocker arm 102 comprises a connecting section 1021 and a linking section 1022 which are fixed together, the connecting section 1021 and the linking section 1022 are matched in an L shape, the free end of the connecting section 1021 is rotatably connected with the shell through a rotary shaft 1023, and the linking section 1022 is fixedly connected with the linking rod 1012; the sliding block 103 comprises a sliding base part 1033 and a connecting part 1034 which are fixed together, the sliding base part 1033 is in sliding fit with the shell, the lock nut 241 is fixedly connected with the sliding base part 1033, and the free end of the connecting part 1034 is connected to the joint of the connecting section 1021 and the linking section 1022. In this way, when the trigger button 1011 is pressed, the linking rod 1012 can drive the rocker arm 102 to rotate, and the sliding block 103 is driven to slide accordingly.

For convenient mounting, a clamping port 1031 matched with the lock nut 241 is formed in the sliding base part 1033, and the lock nut 241 is clamped in the clamping port 1031 during mounting; in addition, for balanced stress of the sliding block 103, the sliding base part 1033 is provided with a pair of mounting posts 1032, the two mounting posts 1032 are located on the two sides of the sliding base part 1033, and a reset spring 104 is arranged on each mounting post 1032.

During spraying, the trigger 101 drives the rocker arm 102 to rotate, the sliding block 103 is made to slide backwards relative to the shell, the lock nut 241 drives the spray needle 237 to move backwards axially in the sliding process of the sliding block 103, the reset spring 104 is in the compressed state, a gap is gradually formed between the front end of the spray needle 237 and the nozzle 232 at the moment, the liquid channel 2351 is opened, and the spray mechanism 23 is in the open state. The larger the backward movement distance of the spray needle 237, the larger the gap between the front end of the spray needle 237 and the nozzle 232 is, and the larger the flow in the liquid channel 2351 is. When the trigger 101 is released, the reset spring 104 drives the sliding block 103 to move forward to restore the spray needle 237, the lock nut 241, the rocker arm 102 and the trigger 101, and the liquid channel 2351 is closed again.

The above description is only the preferred embodiment of the present invention, and all equivalent changes or modifications made according to the structure, characteristics and principle in the application scope of the present invention are included in the application scope of the present invention.

What is claimed is:

1. An integrated spray machine, comprising a shell, a sprayer assembly, an air pump motor assembly, a battery, a circuit board and a switch, wherein the sprayer assembly comprises a housing, a container and a spray mechanism; the housing is matched with the shell, the container and the spray mechanism are mounted in the housing correspondingly, and the container communicates with a liquid inlet of the spray mechanism; the air pump motor assembly, the battery and the circuit board are all mounted in the shell, the switch is arranged on the wall of the shell, the air pump motor assembly, the battery and the switch are all electrically connected with the circuit board, and an air outlet of the air pump motor assembly communicates with an air inlet of the spray mechanism through an air pipe; a trigger starting mechanism used for controlling operation of the spray mechanism is further arranged on the shell; wherein a fixed plate is arranged in the housing, and the container and the spray mechanism are both fixedly connected with the fixed plate; wherein the spray mechanism comprises a handle body, wherein a nozzle and a spray head arranged outside the nozzle in a covering mode are arranged at the front end of the handle body, an end cover is arranged at the rear end of the handle body, the liquid inlet and the air inlet are both formed in the wall of the handle body, the liquid inlet communicates with the front end of the spray head through a liquid channel formed in the handle body, and the air inlet communicates with the front end of the spray head through an air channel formed in the handle body; a spray needle matched with the nozzle is arranged in the handle body, and the trigger starting mechanism is in transmission connection with the spray needle and drives the spray needle to move in the axial direction, so that the liquid channel can be controlled to open or close.

2. The integrated spray machine according to claim 1, wherein a sealing assembly used for preventing liquid in the liquid channel from leaking towards the rear end of the handle body is arranged between the handle body and the spray needle.

3. The integrated spray machine according to claim 2, wherein a lock nut is fixed to the tail end of the spray needle, the trigger starting mechanism comprises a trigger, a rocker arm and a sliding block; the trigger is arranged on the wall of the shell; the rocker arm is rotatably arranged in the shell; the sliding block is in sliding fit with the shell, the trigger, the rocker arm; the sliding block and the lock nut are in transmission connection sequentially, and a reset spring is arranged between the sliding block and the shell.

4. The integrated spray machine according to claim 1, wherein a clamping screw is fixed to the middle of the spray needle, a needle valve spring is arranged between the clamping screw and the end cover in an abutting mode, and the needle valve spring causes the spray needle to close the liquid channel.

5. The integrated spray machine according to claim 4, wherein a lock nut is fixed to the tail end of the spray needle, the trigger starting mechanism comprises a trigger, a rocker arm and a sliding block; the trigger is arranged on the wall of the shell; the rocker arm is rotatably arranged in the shell; the sliding block is in sliding fit with the shell, the trigger, the rocker arm; the sliding block and the lock nut are in transmission connection sequentially, and a reset spring is arranged between the sliding block and the shell.

6. The integrated spray machine according to claim 1, wherein a lock nut is fixed to the tail end of the spray needle, the trigger starting mechanism comprises a trigger, a rocker arm and a sliding block; the trigger is arranged on the wall of the shell; the rocker arm is rotatably arranged in the shell; the sliding block is in sliding fit with the shell, the trigger, the rocker arm; the sliding block and the lock nut are in transmission connection sequentially, and a reset spring is arranged between the sliding block and the shell.

7. The integrated spray machine according to claim 1, wherein an air inlet connector is arranged at the air inlet, a pipe connector used for connecting the air inlet connector with the air pipe is fixed in the shell, and the air inlet connector is matched with the pipe connector in an inserted mode.

8. The integrated spray machine according to claim 1, wherein a plurality of first strong magnetic bars are arranged in the shell, a plurality of second strong magnetic bars in one-to-one correspondence with the first strong magnetic bars are arranged in the housing, and the housing and the shell are fixed together through attraction of the first strong magnetic bars and the second strong magnetic bars.

9. The integrated spray machine according to claim 1, wherein gear indicator lamps are arranged on the shell and electrically connected with the circuit board.

10. The integrated spray machine according to claim 1, wherein that a charging port is formed in the shell and electrically connected with the circuit board.

11. The integrated spray machine according to claim 1, wherein an air inlet connector is arranged at the air inlet, a pipe connector used for connecting the air inlet connector with the air pipe is fixed in the shell, and the air inlet connector is matched with the pipe connector in an inserted mode.

* * * * *